United States Patent [19]

Memminger et al.

[11] Patent Number: 4,953,367

[45] Date of Patent: Sep. 4, 1990

[54] SYSTEM FOR CONTROLLING SUPPLY OF YARN TO A YARN UTILIZATION APPARATUS, PARTICULARLY MULTI-FEED CIRCULAR KNITTING MACHINE

[75] Inventors: Gustav Memminger, Freudenstadt; Heinz Fabschitz, Westerham; Falk Kühn, Rottenburg, all of Fed. Rep. of Germany

[73] Assignee: Memminger Iro GmbH, Freudenstadt, Fed. Rep. of Germany

[21] Appl. No.: 380,145

[22] Filed: Jul. 14, 1989

[30] Foreign Application Priority Data

Jul. 15, 1988 [DE] Fed. Rep. of Germany ..... 3824034

[51] Int. Cl.[5] ..... D04B 15/38; B65H 59/38

[52] U.S. Cl. ..... 66/132 R; 364/470

[58] Field of Search ..... 66/27, 132 R, 132 T; 364/470

[56] References Cited

U.S. PATENT DOCUMENTS

| | | | |
|---|---|---|---|
| 3,677,036 | 7/1972 | Hatay | 66/132 R |
| 3,858,416 | 1/1975 | White et al. | 66/132 R |
| 4,574,353 | 3/1986 | Hellström et al. | 364/470 |
| 4,673,139 | 6/1987 | Memminger et al. | 242/47.01 |
| 4,752,044 | 6/1988 | Memminger et al. | 242/47.01 |
| 4,764,875 | 8/1988 | Carrotte et al. | 364/470 |
| 4,819,310 | 4/1989 | Beerli et al. | 28/185 |
| 4,821,199 | 4/1989 | Kühnert | 66/132 R |
| 4,829,790 | 5/1989 | Memminger et al. | 66/132 R |
| 4,839,815 | 7/1989 | Eaton et al. | 364/470 |

FOREIGN PATENT DOCUMENTS

| | | | |
|---|---|---|---|
| 2126778 | 12/1972 | Fed. Rep. of Germany | 66/132 R |
| 1089194 | 11/1964 | United Kingdom | 66/132 R |

*Primary Examiner*—Werner H. Schroeder
*Assistant Examiner*—John Calvert
*Attorney, Agent, or Firm*—Frishauf, Holtz, Goodman & Woodward

[57] ABSTRACT

A yarn utilizing machine, in particular a circular knitting machine, having a plurality of yarn utilizing stations is provided with a corresponding number of supply means for the yarn. At each supply station, there is a yarn tension or yarn supply quantity monitoring device that cooperates with the yarn. This monitoring device includes a transducer cooperating with the yarn as well as a measuring circuit that emits a signal corresponding to the monitored parameter. To enable recognition of only the deviation of one parameter, independent of the absolute value of the parameter, means are provided for generating a reference value, which is dependent on the measured signals of all the measuring circuits. Each yarn utilizing station or each yarn supply means is provided with a deviation signal circuit, which has two inputs; at least a portion of the reference value is fed into one of the inputs, while at least a portion of the measured signal is fed into the other input. The deviation signal circuit emits a signal only if the reference value and the measured value deviate from one another by more than a fixed amount.

32 Claims, 5 Drawing Sheets

SYSTEM FOR CONTROLLING SUPPLY OF YARN TO A YARN UTILIZATION APPARATUS, PARTICULARLY MULTI-FEED CIRCULAR KNITTING MACHINE

The invention relates to a circuit to monitor and control yarn tension or quantity of yarn being supplied to utilization apparatus, for example a circular knitting machine.

BACKGROUND

When one of the knitting feeds in multi-feed circular knitting machines is using a yarn supply quantity of yarn tension that differs from that of the other feeds, an unattractive defect is the result, especially in plain or unpatterned goods, which precludes use of the goods. It is therefore known to monitor the yarn tension or yarn supply quantity, for example with manual gauges, at the individual knitting stations, and if deviations that would lead to defective goods are found, to make a thorough check. However, such a check may come relatively late after the defect has occurred, by which time a large quantity of defective goods would already then have been produced.

From German Pat. No. 36 27 731, a yarn supply means having electronic yarn tension regulation is known, which has a rotatably supported yarn wheel that supplies the yarn in a substantially slip-free manner. The drive of the yarn wheel, with which other yarn guide elements are also associated, is done with the aid of a stepping motor, which is controlled with an electronic control. The electronic control is substantially a voltage controlled oscillator (VCO), which generates the stepping pulses for the stepping motor. The VCO receives its input signal from yarn tension sensing means that are disposed after the yarn wheel in the course of yarn travel. With the aid of the yarn tension sensing means, a signal that is characteristic for the yarn tension is generated, with the aid of which the VCO is subsequently regulated in such a manner that the yarn tension remains substantially constant.

The known yarn supply means thus receives two electrical signals, one of which characterizes the yarn tension and the other of which, as a frequency signal at the output of the oscillator, characterizes the yarn supply quantity or in other words the yarn quantity per unit of time.

THE INVENTION

It is an object to provide a circuit system that is capable of automatically monitoring the yarn tension or yarn supply quantity, without having to be adapted to various set or desired values for the yarn tension or yarn supply quantity.

Briefly, measuring circuits are coupled between a yarn supply yarn utilization element, such as a knitting feed of a knitting machine, and providing, for each feed, an output signal representative of a yarn supply parameter, such as speed of traveling yarn and quantity used, per unit of time. In accordance with the invention, a reference signal is generated, formed of the yarn measured signals from a plurality, preferably all, of the measuring or sensing circuits of the yarn for the respective knitting feeds. Deviation signals are then generated, by comparing the supply of yarn to any one knitting feed with the reference—which is generated independent on the plurality, or all, of the measuring circuits.

The individual deviation signals then control the yarn supply means with which they are associated so as to null, or reduce to zero, any difference between the actual yarn supply parameters as reflected by the sensing signals and the reference, within a given tolerance band.

Since the novel circuit system includes means for generating a yarn quantity reference value that is dependent on all the measured signals furnished, an automatic adaptation preferably takes place, because the measured signal of each individual measuring circuit is compared at the same time with all the other measured signals, and only a deviation of a particular measured signal from this yarn quantity reference value that is beyond the tolerance band results, via a deviation or error signal circuit, to an error report. Thus the yarn quantity reference value is a kind of floating yarn quantity reference value, which is affected by all the measured signals.

A very simple provision in terms of circuitry is that the means for producing the yarn quantity reference value include the measuring circuits having defined inherent output resistance as well as series resistors connected in series with the outputs of the measuring circuit and a first connecting line, to which all the measuring circuits are connected with an output terminal via the series resistors. The other output terminal is connected to a second common connecting line, which may also be the ground for the circuit. In this circuit, a current is produced in the series resistor that is characteristic of the deviation of the particular measured signal from the floating yarn quantity reference value. The various relationships can be readily calculated and analyzed if the series resistors are identical to one another and if the inherent output resistances are also identical to one another.

The sensitivity of the error or deviation alarm circuit can be varied in a simple manner by dividing each series resistor into at least two partial resistors connected in series, so that a partial voltage can be picked up with the aid of a particular deviation signal circuit.

DRAWINGS

DETAILED DESCRIPTION

Figure 1:
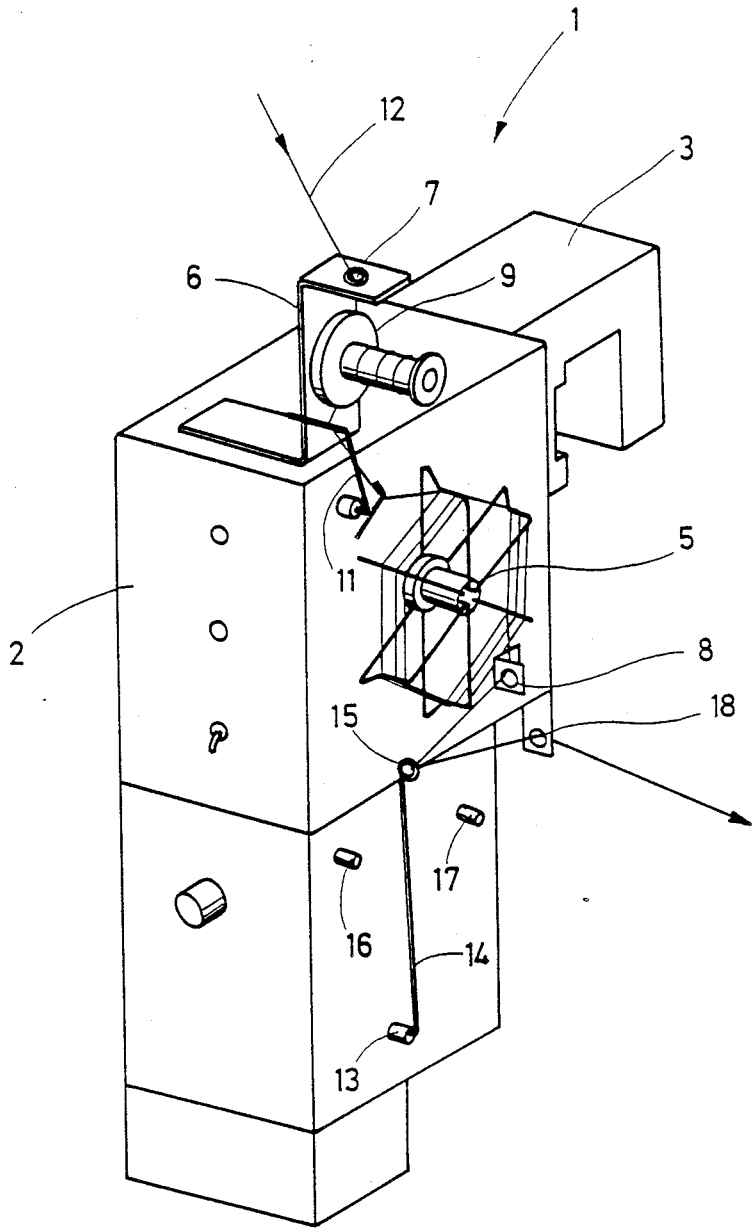
FIG. 1 is a perspective view of a yarn supply means that is suitable for emitting signals characterizing the yarn tension or the yarn supply quantity.

In FIG. 1, a yarn supply means 1 is shown, which has a housing 2 that has a holder 3 arranged for securing the yarn supply means 1 on the frame ring of a circular knitting machine, not otherwise shown, and in the vicinity of which electrical connection devices, again not shown in further detail, for supplying current to the yarn supply means 1 are located. An electric stepping motor 4 (FIG. 2, not visible in FIG. 1) is located in the upper part of the housing 2 and protrudes with its shaft through a suitable opening in the front wall of the housing and drives a yarn wheel 5 mounted in a manner fixed against relative rotation on the shaft. Stationary yarn guide elements are associated with the yarn wheel 5 and located on the housing 2, comprising an entry eyelet 7 provided on the holder 6 attached to the housing and a yarn eyelet 8 located on the housing 2 on the yarn exit side of the yarn wheel 5. For monitoring and controlling the yarn travel, a yarn brake plate and a yarn entry sensor 11 are provided below the yarn eyelet 7, that is, between the yarn eyelet 7 and the yarn wheel 5. The yarn entry sensor monitors the yarn 12 for yarn breakage, by resting with its sensor arm on the yarn 12 traveling past it, and if the yarn breaks it emits an electrical signal for shutting off the circular knitting machine, not shown.

Below the yarn wheel 5 and axially parallel with it in the housing 2, a yarn guide arm 14 is rotatably supported at 13 about an axis that is parallel to the axis of the yarn wheel 5. The yarn guide arm 14 and its yarn eyelet 15 on the one hand form a yarn reserve, because it is movable back and forth between two stationary stops 16 and 17 on the front side of the housing 2, and it also serves as a sensor element of the rpm of the stepping motor 4, in order to regulate the yarn tension or yarn supply quantity so as to keep them constant. To this end, the yarn guide arm 14 is biased in the direction away from the stop 16, or in other words away from an eyelet 18, which is located offset below the yarn eyelet 8. The biasing of the yarn guide arm 14 is done with the aid of a biasing device 19 schematically shown in FIG. 2.

The position of the yarn guide arm 14 is ascertained with the aid of an electrooptical signal transducer 21, which includes both a light emitting diode or LED 22 located in the housing and a photoelectric transistor 23 located in the path of the beam of the LED 22; both of these elements are mounted on a holder 24 attached to the housing. A dimmer disk 25 coupled to the yarn guide arm 14 in a manner fixed against relative rotation protrudes to a variable extent into the course of the beam of the LED 22, and depending on the position of the yarn guide arm 14 it allows more or less light from the LED 22 to reach the photoelectric transistor 23. The result is a voltage signal proportional to the angular position of the yarn guide arm 14, which is fed via a line 26 to a voltage regulated oscillator or VCO 27. The VCO 27 furnishes stepping or clocking pulses at its output 28, which via a multiwire line 29 are fed to the windings of the stepping motor 4, causing the motor to rotate accordingly. Via a further line 31, the clock signal of the VCO 27 is also fed to a frequency voltage converter 32, which at its output, via a line 33, emits an analog signal which is proportional in amplitude to the stepping frequency and hence to the quantity of yarn furnished by the stepping motor 4. The yarn supply quantity for the knitting station of the circular knitting machine is linked to the frequency, via the stepping angle of the stepping motor 4 and the respective diameter of the yarn wheel 5.

Figure 3:
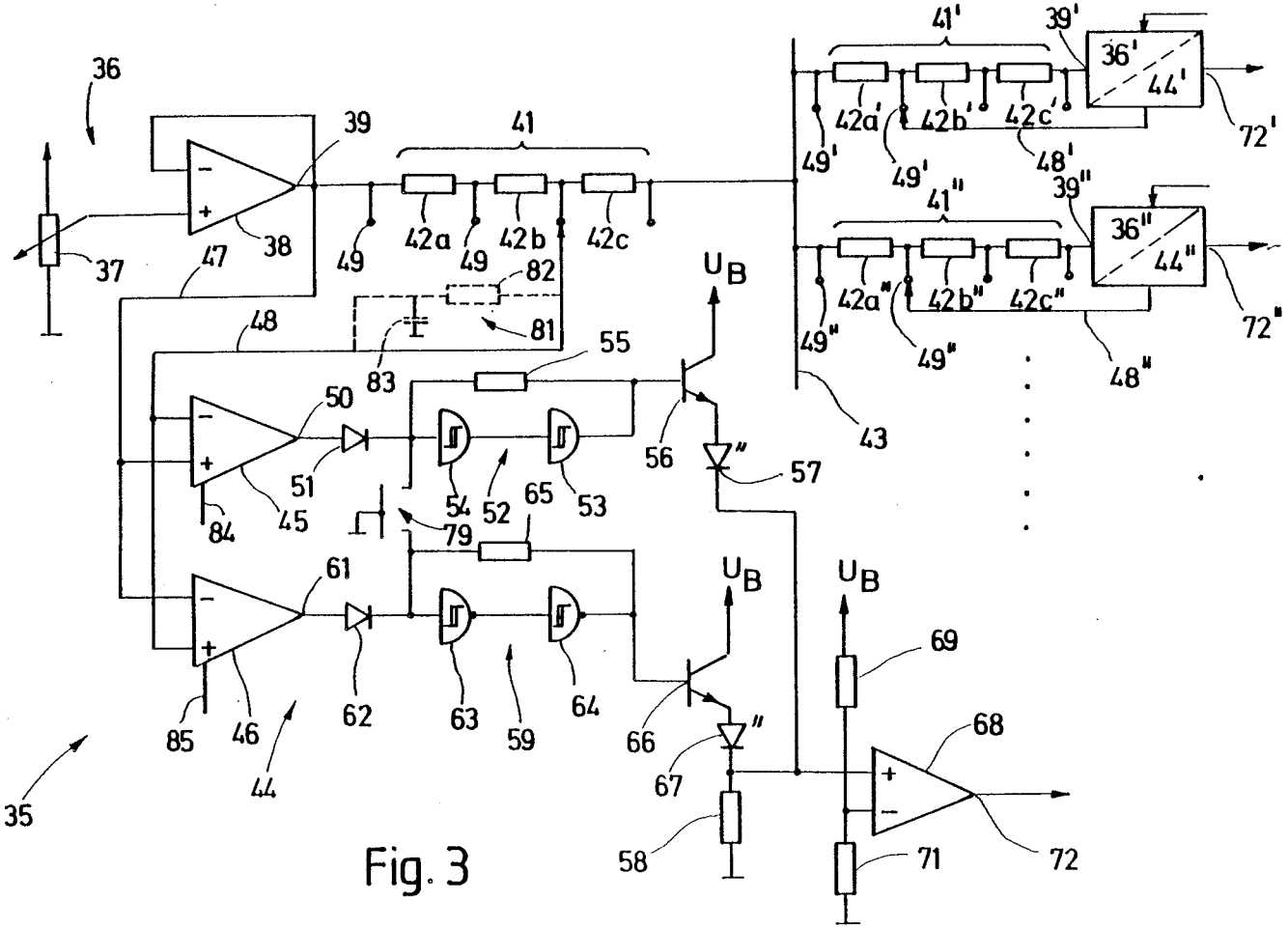
FIG. 3 shows the circuit system according to the invention for monitoring the yarn tension or the yarn supply quantity.

A number of yarn supply means or units 1 are used at a large multi-feed circular knitting machine, each unit controlling the supply of yarn to one knitting station of the circular knitting machine. If the knitting cams of the machine are adjusted entirely uniformly, then the yarn consumption at all the stations is the same, at least at the same machine speed or rpm. However, if variations arise at the knitting stations, leading to an increased or decreased yarn consumption by comparison with the other knitting stations, the result is an undesirable unevenness in the knitted goods, which is particularly obvious and problematic in plain, unpatterned goods. To monitor the yarn consumption of the various knitting stations, each of which is supplied by a yarn supply means 1 of FIG. 1, the circuit system 35 shown in FIG. 3 is provided.

The circuit system 35 includes one measuring circuit 36, for each knitting station, with which the yarn consumption at each knitting station is ascertained. This measuring circuit comprises the frequency voltage converter 32 shown in FIG. 2, the output signal of which is fed via the line 33 to a grounded voltage divider in the form of a potentiometer 37. A negative-feedback differential amplifier 38 wired as an electrometer amplifier is connected with its noninverting input to the wiper of the potentiometer 37 and is negatively fed back from its output 39 to its inverting input. The measuring circuit 36, at its output 39, thus receives a defined low inherent output resistance and its sensitivity can be adjusted via the potentiometer 37; that is, the ratio between the amplitude of the output signal at the output 39 and that of the input signal proportional to the yarn supply quantity can be varied.

Via a series resistor 41, which is formed of a plurality of series-connected partial resistors **42*a*–42*c*, the output 39 of the measuring circuit 36 is connected to a common connecting line 43. The measuring circuits 36', 36'' and so forth, which are associated with the other yarn supply means 1 of the other knitting stations, are also connected to this connecting line 43, via the associated series resistors 41', 41'' and so forth. The yarn supply quantity is ascertained in the other measuring circuits 36', 36'' as well via a corresponding frequency voltage divider 32 of the kind shown in FIG. 2**.

Since the measuring circuits 36 . . . 36'' and so forth are all connected via series resistors 41 . . . 41'' to the connecting line 43, a voltage counter to the ground of the circuit is established there, which is dependent on the output voltages of all the measuring circuits 36 . . . 36'', in a manner to be explained hereinafter. The circuit ground at the same time forms the second output terminal of the measuring circuits 36 . . . 36'' and so forth, as well as the second common connecting line, which as compared with the connecting line 43 carries the aforementioned voltage, which serves as a yarn quantity reference voltage for a deviation signal circuit 44. The deviation signal circuit 44 comprises two differential amplifiers 45 and 46 functioning as comparators, which are connected in parallel at the input side; the inverting input of the differential amplifier 45 is connected to the noninverting input of the differential amplifier 46, and the noninverting input of the differential amplifier 45 is connected to the inverting input of the differential amplifier 46. A voltage is fed into the thus interconnected inputs of the two differential amplifiers 45 and 46 that comprises the voltage drop at the series resistor 41, or a portion thereof; the noninverting input of the differential amplifier 45 is therefore connected via a connecting line 47 to the output 39 of the measuring circuit 36, while the inverting input of this same differential amplifier can be connected via a connecting line 48 to one of the pickups 49 between the partial resistors **42*a* . . . 42*c***.

For storing the possibly temporary switching state of the differential amplifier 45 in memory, a memory element comprising two series-connected inverters 53 and 54 having a Schmitt trigger characteristic is connected to the output 50 of this differential amplifier, via a diode 51. Specifically, the anode of the diode 51 is connected to the output 50, while its cathode is connected to the input of the first inverter 54. From the output of the inverter 54, the signal reaches the input of the inverter 53, from the output of which a feedback resistor 55 leads back to the input of the first inverter 54. The base of an n-p-n transistor 56 is also connected to the output of the inverter 53; the emitter of this transistor is connected via an LED 57 and a multiplier resistor 58 to the circuit ground. The collector of the transistor 56 receives the positive supply voltage $U_B$.

A further memory element 59 is connected to the output side of the differential amplifier 46, to the output 61 of which a diode 62 is connected, which connects the output 61 to the input of a first inverter 63 having a Schmitt trigger characteristic. Its output is connected to the input of a second inverter 64, again having a Schmidt trigger characteristic, from the output of which a resistor 65 leads back to the input of the first inverter 63. By means of the positive feedback, the memory element 59 is maintained in the state imposed upon it at the input via the diode 62.

From the output of the inverter 64, a connection leads to the base of n-p-n transistor 66, the collector of which receives the positive supply voltage and the emitter of which is connected via an LED 67 to the connecting point between the LED 57 and the multiplier resistor 68. The noninverting input of a further differential amplifier 68 is at this connecting point between the two LEDs 57 and 67, normally operated in the conducting direction, and its inverting input, via two resistors 69 and 71 connected as voltage dividers, receives a machine speed reference voltage based on the positive supply voltage $U_B$; this reference voltage is compared by the differential amplifier 68 with the voltage at the multiplier resistor 68. In accordance with this comparison, the differential amplifier 68 generates a binary signal, which is either H or L, at its output 72.

The circuit system 35 includes one such deviation signal circuit 44 for each yarn supply means 1 of the circular knitting machine, which is represented by the deviation signal circuits 44', 44'', and so forth, which all have the same design and are connected in the same way to the series resistors 41, 41', 41'', and so forth of the associated measuring circuit 36, 36', 36''. The description of the function of the deviation signal circuit 44 that follows is accordingly equally applicable to the other deviation signal circuits 44' and so forth.

To facilitate comprehension of the function of the circuit system 35, the substitute circuit diagram of FIG. 4 will first be described. If n individual voltage sources, which all have the same inherent resistance R and the imposed voltage $U_M$, are connected in parallel, then the result is a substitute voltage source 73 having a substitute inherent resistance 74, which like the individual voltage sources has the imposed voltage $U_M$. The substitute inherent resistance 74, however, has the value R/n. If a further voltage source 77, which has the inherent resistance 78 having the value R and the imposed voltage ($U_M+\Delta U$), is connected to this substitute voltage source 73 between its terminals 75 and 76, then by application of Kirchhoff's rules, the current through the resistor 78 satisfies the following equation:

$$I = \frac{U \cdot n}{R(n+1)}$$

The current through the resistor 78 is thus directly proportional to $\Delta U$; that is, the voltage drop at the resistor 78 is proportional to $\Delta U$ and disappears whenever $\Delta U$ becomes 0. Moreover, the direction of the voltage drop reverses whenever $\Delta U$ has the opposite polarity of $U_M$ of the voltage source 77. $\Delta U$ is independent, contrarily, on the magnitude of $U_M$. On the other hand, the terminal voltage $U'_M$ between the terminals 75 and 76 varies as follows:

$$U'_M - U_M + \Delta U/(n+1).$$

From these equations, it follows that the terminal voltage $U'_M = U_M$ as long as $\Delta U$ is 0, becomes less whenever $\Delta U$ has opposite polarity from $U_M$, and becomes greater whenever $\Delta U$ and $U_M$ have the same polarity.

If the principles are applied to the circuit system 35, then the following is true: In the circular knitting machine having n+1 knitting stations, an equal number of measuring circuits 36 and deviation signal circuits 44 are present. Each of the measuring circuits has the same inherent output resistance, measured at the output 39, at which the series resistor 41 is connected in parallel. The series resistor 41 together with the inherent output resistance of the differential amplifier 38 forms the resistor 78, having the value R, shown in the substitute circuit diagram.

Now if it is initially assumed that the same yarn consumption prevails at all the n +1 knitting stations, then all the yarn supply units 1 furnish a voltage signal via the line 33 that has the same value in all cases. The yarn supply unit 1 thus functions in connection on with the circuit system 35 as a yarn quantity gauge, the signal of which undergoes further processing. If the yarn quantity per unit of time is identical at all the knitting stations, the output signals of the all the differential amplifiers 38 of the various measuring circuits 36 . . . 36'' will also be the same. Because the series resistors 41, 41', 41'' and so forth are identical, and the inherent output resistances of the negative-feedback differential amplifiers 38 are also identical, a voltage appears on the connecting line 43 that is equal to the output voltage of the individual differential amplifiers 38. It is further assumed, for the sake of simplification, that the inherent output resistance of the differential amplifiers 38 is low compared with the series resistor 41 and is therefore negligible. The differential amplifier 38 thus corresponds to the imposed voltage $U_M$, which is present at the line 43, via the series resistor 41 having the value R.

If the yarn consumption at one of the knitting stations should change, then is a consequence the output voltage of the differential amplifier 38 at the associated measuring circuit 36 varies from the original $U_M$ to $U_M+\Delta U$. At all the other knitting stations, it is assumed for the sake of simplicity that no change takes place. Thus in accordance with the above explanation referring to FIG. 2, a transverse current is produced in the series resistor 41, this current being proportional to the voltage variation $\Delta U$, which in turn characterizes the additional or deviating yarn consumption of the applicable knitting station. The incident current in the resistor 41 there consequently causes a voltage drop, which- is picked up either at the entire series resistor 41 or at a part thereof and is fed into the two comparators 45 and 46.

If the polarity of the voltage drop is such that the line 47 becomes positive by a corresponding amount compared with the line 48, then the voltage at the output 50 changes from the value of 0 to a positive value that is somewhat less than $U_B$. The diode 51 which as a result is polarized in the conducting direction allows the voltage change in the direction of $U_B$ to reach the inverter 54, the output of which drops to a low voltage, which in turn results in a high voltage at the output of the inverter 53, and this high voltage is fed back via the resistor 55 to the input of the inverter 54. Even if U should disappear again, so that the voltage at the output 50 of the differential amplifier 45 returns to the original value, the memory element 52 made up of the two inverters 53 and 54 remains in the changed-over state, with high voltage at the output of the inverter 53.

By means of the high voltage at the output of the inverter 53, the transistor 56 is triggered and thereupon sends a current through the LED 57 and the multiplier resistor 58. The result of the multiplier resistor 58 is a voltage drop, which is compared by the differential amplifier 68 with a machine speed reference voltage, which is compared with the supply voltage $U_B$ with the aid of the two voltage divider resistors 69 and 71.

If the voltage drop at the multiplier resistor 58 is greater than the machine speed reference voltage, then a positive signal appears at the output 72, which can be used to shut off the circular knitting machine. The LED 57 tells the maintenance staff which knitting station had an excessively high yarn consumption.

By the selection of the corresponding pickup 49 between the partial resistors 42a–42c, the sensitivity of the circuit system 35 can be varied; the sensitivity is less, the smaller the partial resistor at which the voltage for the differential amplifier 45 is picked up, while on the other hand the sensitivity is the greater, the greater the number of partial resistors 42a–42c connected into the circuit.

On the other hand, if the yarn consumption at one knitting station drops, then the result at the series resistor 41 of the measuring circuit 36 belonging to this knitting station is a voltage drop, which compared with the above-described operating situation has the opposite polarity. The voltage on the line 48 becomes positive compared with the voltage on the line 47, with the result that the differential amplifier 46, upon attaining a predetermined voltage difference at its two inputs, emits a positive signal at its output 61. This positive signal, which characterizes the decreased yarn consumption, switches over the subsequent memory element 59; this memory element functions in the same manner as the memory element 52. This triggers the transistor 66, which turns the LED 67 on, and causes a corresponding voltage drop at the resistor 58. This voltage drop is evaluated by the differential amplifier 68 as before and is converted into a shutoff signal for the circular knitting machine.

To enable resetting of the memory elements 52 and 59 after the problem has been overcome, one working contact 79 connected to ground is connected to each of the inputs of the two inverters 54 and 63; by means of this contact 79, the input of the inverters 54 and 63 can be manually grounded, which also causes the output signal of the last inverter 53 or 64 to have the L level. Since this level, as mentioned above, is fed back via the resistors 55 and 65, the memory elements 52 and 59 remain in this state whenever the working contact 79 is released and returns to its position of repose.

To prevent brief transient signal variations in the measured signal from causing a shutoff of the circular knitting machine, a delaying RC element 81 can be provided in the line 48, comprising a longitudinal resistor 82 and a grounded capacitor 83. The RC element 81 is shown enclosed in dashed lines in FIG. 3 and represents an alternative to the solid line 48 shown in this region. Depending of the selection of the time constants of this RC element 81, signal pulses of a corresponding duration are filtered out, and the measured signal must have a level that signals an error for at least as long as a time defined by the time constant of the RC element 81, before one of the two differential amplifiers 45, 46 can respond.

So that extremely small voltage drops at the series resistor 41 or its partial resistors 42a–42c will not already be able to switch the differential amplifiers 45 and 46 over, these amplifiers preferably operate with a larger offset, in such a way that the output signal of the differential amplifier 46, for example, does not begin to become positive until the noninverting input has a nonnegligible positive voltage compared with the inverting input.

If differential amplifiers of the types having offset compensation are used for the differential amplifiers 45 and 46, then via this connection, which is shown at 84 and 85 in FIG. 3, a change in the sensitivity in the deviation signal circuit 44 can be attained, without having to select some other pickup 49 at the series resistor 41. By simply feeding in a suitable signal to these parallel-connected offset compensation inputs 84 and 85, all the deviation signal circuits can be switched over centrally.

Figure 4:
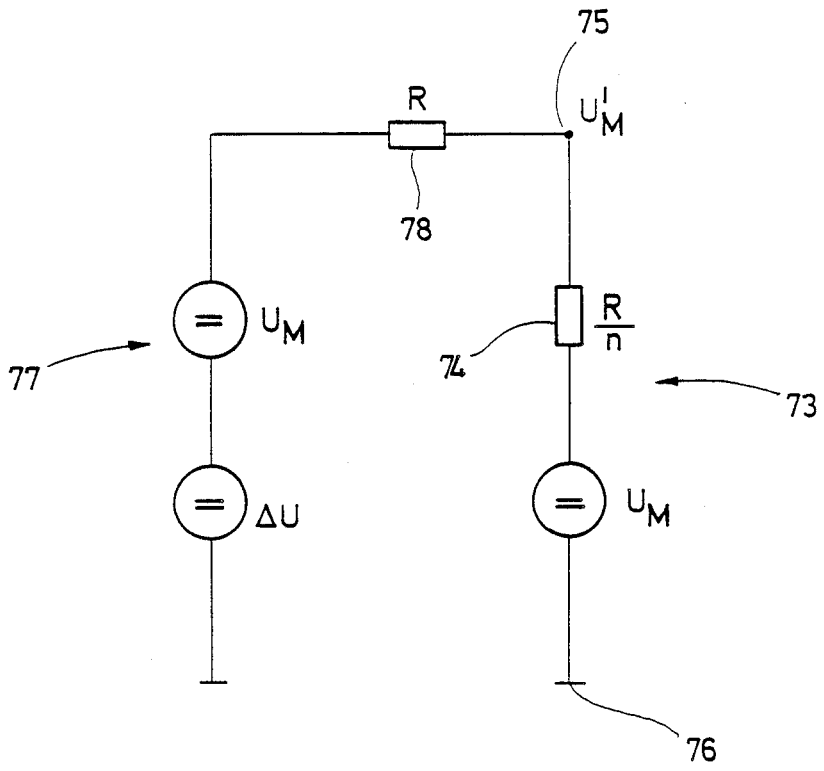
FIG. 4 is a substitute circuit diagram explaining how the yarn quantity reference value is produced.

From the above explanation in combination with FIG. 4, it can be seen that for the function of the circuit system 35 with all its monitoring circuits 44, 44', 44'' and the measuring circuits 36, 36', 36'' and so forth, the absolute magnitude of the voltage on the line 43 does not play any role. A circuit system 35 therefore does nor have to be adapted to other yarn supply quantities upon switchover. For the same reason, it does not produce undesirable error reports whenever all the knitting stations move uniformly in the same direction in terms of their yarn consumption over the course of time, because it responds only when one of the knitting stations has a yarn consumption that deviates markedly from the others. The circuit is therefore secure against incorrect alarms such as would arise if each station were compared per se with an absolute yarn quantity reference value and not, as in the novel circuit system, with a floating yarn quantity reference value.

Instead of checking the yarn supply quantity, as in the exemplary embodiment shown, the yarn tension can conversely be checked at all the knitting stations, in which case instead of the signal on the line 33, the regulating signal for the VCO 27, which is fed in at its input, becomes the basis of the measured signal.

Figure 2:
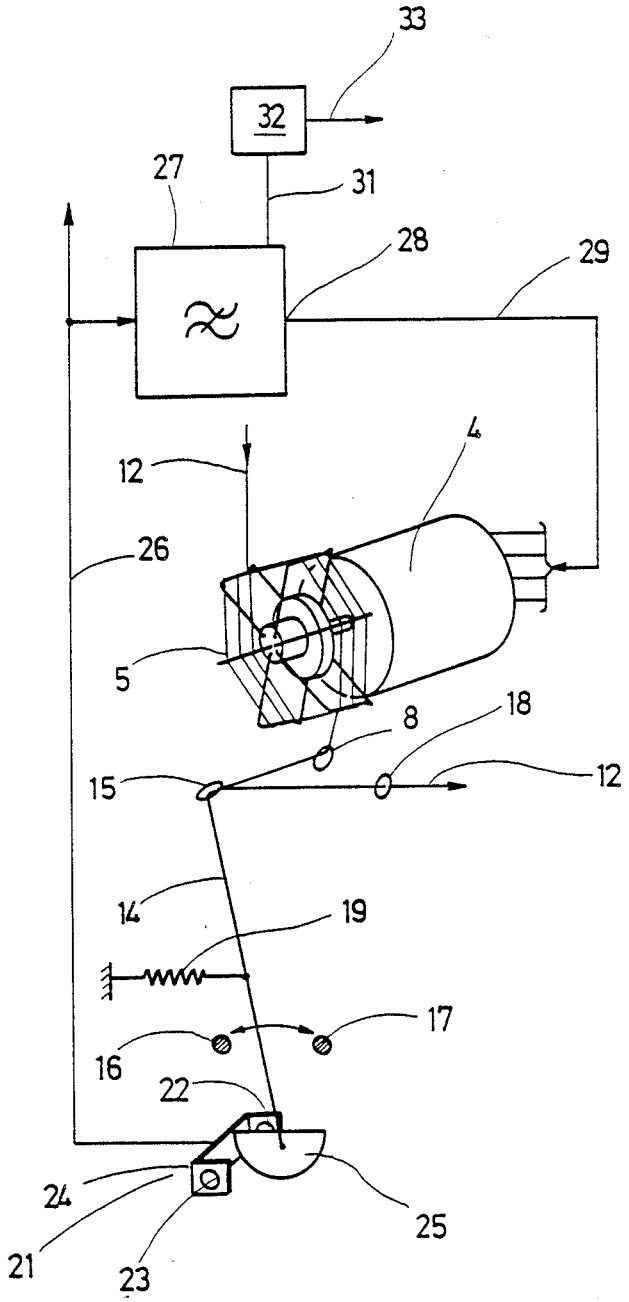
FIG. 2 is a block circuit diagram for the yarn supply means of FIG. 1.

For the case where yarn supply means that are driven mechanically via bells and the like are used, suitable yarn quantity or yarn tension gauges can be incorporated in the yarn travel route of the various knitting stations, and these gauges can furnish the required electrical signal. The yarn supply unit 1 shown in FIGS. 1 and 2 is in this sense shown only as an example. The novel circuit system is not restricted to being used in combination with such electronically regulated yarn supply units 1.

Figure 5:
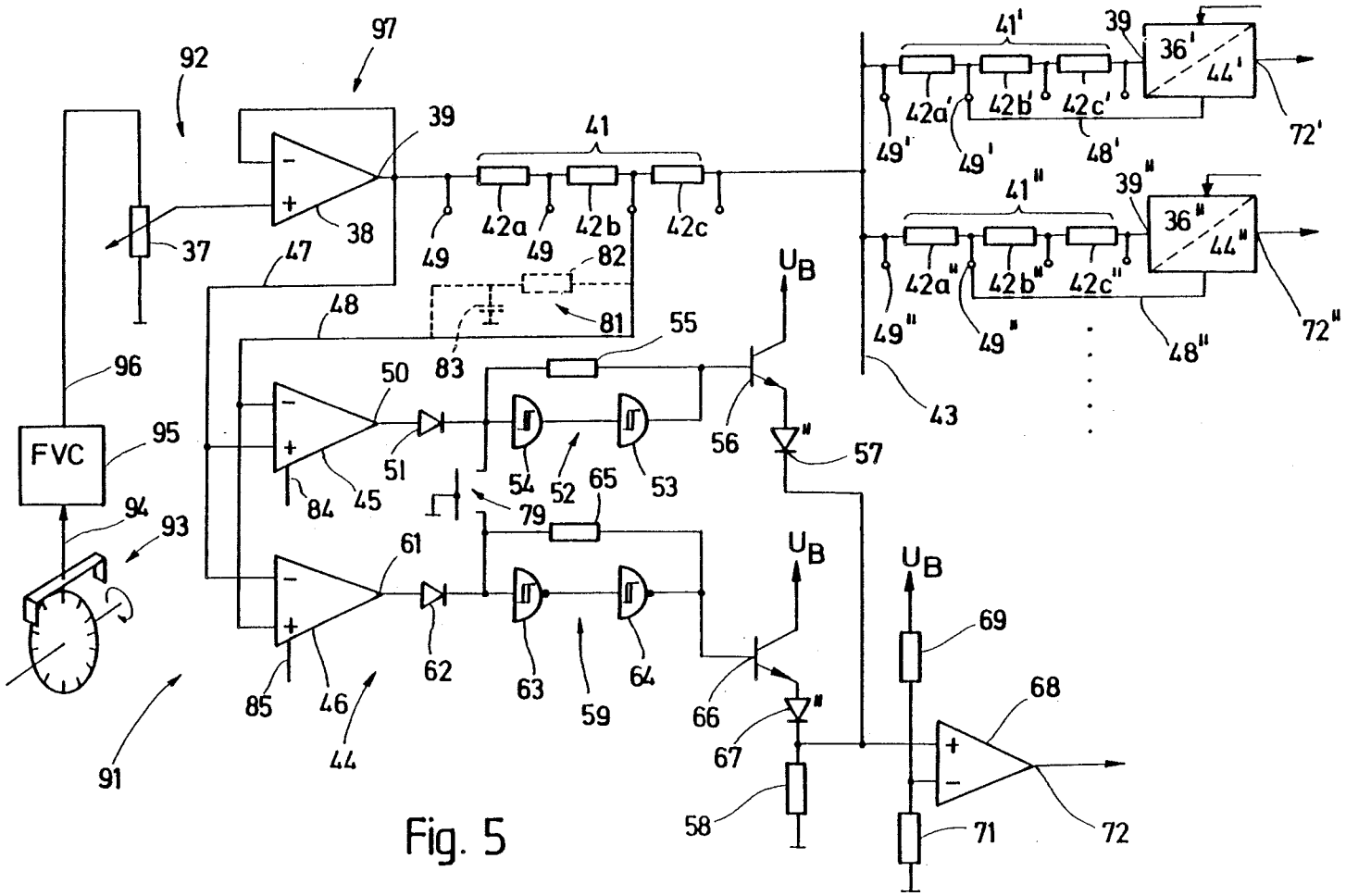
FIG. 5 shows a circuit system for the yarn supply quantity having a machine speed reference value corresponding to the rpm of the machine utilizing the yarn.

FIG. 5 shows an additional feature for the circuit system of FIG. 3, with which not only can the individual yarn supply stations be compared with one another, but the yarn consumption of the supply stations can be compared with a reference value which is dependent on the rpm, or operating speed, of the circular knitting machine. To this end, a comparator circuit 91 is connected to the connecting line 43 and has both a machine speed reference value generating circuit 92 and a deviation signal circuit 44, which is identical in structure to the deviation signal generating circuit 44, 44', 44" and so forth of FIG. 3 and associated with the individual yarn supply stations. Accordingly, the same reference numerals are used for the components of the deviation signal circuit 44 of FIG. 5 as for the circuit system of FIG. 3; the description provided in conjunction with FIG. 3 as to the structure and the function of the deviation signal circuit is equally applicable to the deviation signal circuit 44 of FIG. 5.

The machine speed reference value generating circuit 92 receives an rpm-proportional signal with the aid of an optical rpm transducer 93, which is coupled in a phase-locked manner to the drive system of the circular knitting machine and emits an electrical signal on a line 94 the frequency of which is strictly proportional to the machine rpm. Optical rpm transducers of this kind are known, and a symbolic illustration of the rpm transducer 93 is accordingly sufficient.

The frequency signal obtained passes via the line 94 to a frequency voltage converter 95, which converts the frequency signal into an analog signal which is proportional in amplitude to the frequency. Suitable circuits for this purpose are also known, and so the internal structure of the frequency voltage converter does not need to be described in detail. Its output signal passes via a line 96 into an amplifier arrangement 97, which beginning at the potentiometer 37 and extending as far as the series resistors 41 has the same structure as the measuring circuits 36, 36', 36" and so forth of FIG. 3. The description in conjunction with FIG. 3 on the structure and function of this arrangement accordingly applies here as well, with the single difference that the hot end of the potentiometer 37 is supplied not with the signal from the line 33 or the line 96 that is proportional to the yarn supply quantity or to the yarn tension, respectively, but rather with the signal from the line 96 that is proportional to the rpm of the circular knitting machine.

The comparator circuit 91 thus, on the one hand, contributes a small amount to the yarn quantity reference value on the connecting line 3, to which it, like the other measuring circuits 36 . . . 36", is connected, and on the other hand, its deviation signal circuit 44 checks the rpm-proportional signal value present at the output 39 with the yarn quantity reference value that is present at the connecting line 43. Because this reference value on the connecting line 43 is dependent on the yarn supply quantity of the individual yarn-using stations, it will have a voltage that, presuming a properly adjusted circular knitting machine, increases in proportion to the rpm of the circular knitting machine. The machine speed reference value that is produced via the reference value generating circuit 92 will rise in the same manner. The machine speed reference value is thus the theoretical yarn consumption of the circular knitting machine, with which the floating yarn quantity reference value of the line 43 is compared with the aid of the deviation signal circuit 44 of FIG. 5.

If excessively large deviations arise in this comparison, which is characterized by a corresponding voltage drop at the series resistor 41, than the deviation signal circuit 44 of the comparator circuit 91 generates a corresponding shutoff signal for the machine at its output 72 and also, at its LEDs 57 and 67, indicates whether the actual yarn consumption is above or below the value fixed by the machine speed reference value.

The deviation signal circuit to each yarn using station includes at least one comparator, the two inputs of which form the inputs of the deviation signal circuit. This voltage may be the total voltage drop at the series resistor, with which the maximum sensitivity is established, or it may be the voltage at a partial resistor, which represents a corresponding reduction in sensitivity. Correspondingly, a greater upward or downward deviation of the yarn tension or the yarn supply quantity from the yarn quantity reference value is allowable before the deviation signal circuit responds to emit an error or deviation signal. Another way of varying the sensitivity of the deviation signal circuit is to provide means for varying the offset voltage of the comparator. An arrangement of this kind affords the opportunity of varying all the deviation signal circuits centrally, via a single electrical signal.

The same inherent output resistance for all the measuring circuits can be attained in the simplest case by providing that the signal output stage include a differential amplifier wired as a negative-feedback electrometer amplifier, because in this way the output wiring of the differential amplifier has no effect on the inherent output resistance. On the other hand, the amplification and hence the sensitivity of the measuring circuit is very stable over long periods of time and is independent, within wide limits, of the parameters of the differential amplifier.

If a value that exceeds or falls below the yarn quantity reference value is intended to lead to a deviation or error signal, then each deviation signal circuit includes two comparators, one of which monitors the exceeding of the threshold in a fixed direction; that is, one monitors the upper threshold and the other the lower threshold.

To prevent transient changes in the yarn tension or yarn supply quantity from causing the shutoff of the machine, the deviation signal circuit may be supplied with the measured signal after a delay.

Finally, it is possible to provide memory elements in each deviation signal circuit, which can be selectively reset from the outside in order to produce an error signal of arbitrary duration, once the deviation signal circuit has responded for the first time.

Under certain operating conditions, it is important for the knitting machine operator to know that the machine is not consuming yarn to an extent that deviates more than a fixed amount from a fixed yarn consumption relating to the machine speed, or rpm. This can be very simply attained with the novel circuit system by providing comparator means, for comparing the yarn quantity reference value with a machine speed reference value dependent on the rpm of the machine. These machine speed comparison means are preferably largely of the same structure as the measuring circuits and deviation signal circuits assigned to the individual yarn supply stations, in order to keep the expense for circuitry and manufacture as low as possible; the sole difference is that a signal proportional to the machine rpm is fed into the signal input of the measuring circuit. The machine rpm transducer, together with the measuring circuit, forms a reference value generating circuit that advantageously has the same electrical parameters as the other measuring circuits on its output side, and in turn is connected via series resistors to the first connecting line.

The deviation signal circuit of the comparison means again has the same structure as the deviation signal circuit associated with the yarn supply means and thus at its input receives at least a portion of the yarn quantity reference value, while at the other input at least a portion of the machine speed reference value is fed in.

Thus an error or deviation signal can be produced whenever the machine speed reference value generated via the comparison means, which corresponds to the theoretical yarn consumption of the machine, deviated excessively from the yarn quantity reference value, which is dependent on the one hand on the machine speed reference value and on the other hand on the supply quantities at the various yarn supply stations; the measured signals that arrive from the yarn supply means affect the yarn quantity reference value more, because hey are greater in number, than does the machine speed reference value.

Various changes and modifications may be made and any features described may be used with any others, within the scope of the inventive concept.

What is claimed is:

1. System for controlling supply of yarn (12) to a yarn utilization apparatus, particularly a multi-feed circular knitting machine having a plurality or yarn supply means (1);

a plurality of yarn utilization stations, receiving the yarn from the yarn supply means;

a plurality of sensing means (21, 22) coupled to the yarn (12) running between the yarn supply means and the utilization stations and providing yarn supply parameter signals;

a plurality of measuring circuits (36 . . . 36″) coupled to receive the yarn parameter signals and having output terminals (39 . . . 39″) for delivering output signals which have a characteristic of the parameter of the yarn during supply of the yarn (12) from the yarn supply means to the utilization station, and comprising, in accordance with the invention reference signal generating means (38, 41 . . . 41″, 43) coupled to a predetermined plurality of the measuring circuits for generating a reference signal, which reference signal is dependent on all the output signals from said predetermined plurality of measuring circuits (36 . . . 36″);

a deviation signal generating circuit (44—44″) associated with each of the yarn supply means and coupled to receive (a) the reference signal; and (b) the output signals from the measuring circuit associated with the respective yarn supply means, and generating respective deviation signals if the output signals applied to the deviation signal generating circuit, and the reference signals representative of the respective parameters of the predetermined plurality of measuring circuits, differ by a predetermined value.

2. System of claim 1, wherein (FIG. 3) yarn quantity reference signal generating means (36 . . . 36″) have predetermined inherent output resistance and comprise series resistors (41 . . . 41″) connected in series with the outputs (39 . . . 39″) of the measuring circuits (36 . . . 36″) and a first connecting line (43), to which all the measuring circuits (36 . . . 36″) are connected with their outputs (39 . . . 39″) via the series resistors (41 . . . 41″), and that another of the output terminals of each measuring circuit (36 . . . 36″) is connected to a common second connecting line (circuit ground).

3. System of claim 2, wherein each series resistor (41 . . . 41″) comprises at least two series-connected partial resistors (42*a*. . . 42*c*, . . . 42″. . . 42*c*″).

4. System of claim 2, wherein the inherent output resistances of the measuring circuits (36 . . . 36″) are the same.

5. System of claim 2, wherein the series resistors (41 . . . 42″) are identical.

6. System of claim 1, wherein each measuring circuit (36 . . . 36″) includes, as a signal output stage, a differential amplifier (38) which is wired as a negative-feedback electrometer amplifier.

7. System of claim 1, wherein each deviation signal circuit (44 . . . 44″) includes at least one comparator (45, 46), the two inputs of which form the inputs of the deviation signal circuit (44 . . . 44″).

8. System of claim 2, wherein each deviation signal circuit (44 . . . 44″) includes at least one comparator (45, 46), the two inputs of which form the inputs of the deviation signal circuit (44 . . . 44″), and wherein a voltage that is proportional to the voltage dropped at the respectively associated series resistor (41 . . . 41″); is fed in between the two inputs (47, 48) of the comparator (45, 46).

9. System of claim 8, wherein the voltage drop at the respective series resistor (41 . . . 41″) is the voltage drop at a corresponding partial resistor (42*a*. . . 42*c*, . . . 42*a*″. . . 42*c*″) of the particular series resistor (41 . . . 41″).

10. System of claim 7, wherein for variation of the voltage difference at the inputs of the comparator (45, 46) that leads to the output signal, offset adjusting means (84, 85) are associated with the comparator (45, 46).

11. System of claim 1, wherein each deviation signal circuit (44 . . . 44″), for ascertaining whether the measuring signal exceeds or drops below the yarn quantity reference value by an allowable tolerance value, has two comparators (45, 46).

12. System of claim 1, wherein each deviation signal circuit (44 . . . 44″) includes memory elements (52, 59).

13. System of claim 7, wherein each deviation signal circuit (44 . . . 44″) includes memory elements (52, 59), and the memory element (52, 59) is connected to the output of the associated comparator (45, 46).

14. System of claim 1, wherein the input of the deviation signal circuit (44 . . . 44″) is preceded by a time-delaying and pulse-filtering element (80).

15. System or claim 1, wherein each measuring circuit (36 . . . 36″) includes means (37) for adjusting the sensitivity.

16. System of claim 1, wherein comparison means (91) are provided for comparison of the yarn quantity reference value with a machine speed reference value dependent on the rpm of the yarn utilizing machine.

17. System of claim 16, wherein the comparison means (91) have a machine speed reference value generating circuit (92) and a deviation signal circuit (44); the machine speed reference value generating circuit (92) has a signal output (39) having a defined inherent output resistance; the deviation signal circuit (44) includes two inputs (47, 48), one of which is supplied with at least a portion of the yarn quantity reference value and the other of which is supplied with at least a portion of the output signal of the machine speed reference value generating circuit (92); and that the deviation signal circuit (44) emits an error signal whenever the machine speed reference value and the yarn quantity reference value deviate by more than a fixed value from one another.

18. System of claim 17, wherein a series resistor (41) that is connected to the first connecting line (43) is connected in series with the output (39) of the machine speed reference value generating circuit (92).

19. System of claim 18, wherein the series resistor (41) comprises at least two series-connected partial resistors (42*a*. . . 42*c*).

20. System of claim 17, wherein the inherent output resistance of the machine speed reference value generating circuit (92) is equal to the inherent output resistance of the measuring circuits (36 . . . 36″).

21. System of claim 19, wherein the series resistor (41) of the machine speed reference value generating circuit (92) is identical to the series resistor (41 . . . 41″) of the measuring circuits (36 . . . 36″).

22. System of claim 17, wherein the machine speed reference value generating circuit (92) contains, as a signal output stage, a differential amplifier (38) which is wired as a negative-feedback electrometer amplifier.

23. System of claim 17, wherein the deviation signal circuit (44) of the comparison means circuit (91) includes at least one comparator (45, 46) the two inputs of which form the inputs of the deviation signal circuit (44).

24. System of claim 23, wherein a voltage that is proportional to the voltage drop at the series resistor (41) of the associated machine speed reference value generating circuit (92) is fed in between the two inputs (47, 48) of the comparator (45, 46).

25. System of claim 24, wherein the voltage drop at the series resistor (41) is the voltage drop at a corresponding partial resistor (42*a*. . . 42*c*) of the machine speed reference value generating circuit (92).

26. System of claim 23, wherein for variation of the voltage difference at the inputs of the comparator (45, 46) of the comparison means circuit (91), which leads to an output signal, offset adjusting means (94, 95) are associated with the comparator (45, 46).

27. System of claim 17, wherein each deviation signal circuit (44), for ascertaining whether the machine speed reference value exceeds or drops below the yarn quantity reference value by an allowable tolerance value, has two comparators (45, 46).

28. System or claim 17, wherein each deviation signal circuit (44) includes memory elements (52, 59).

29. System of claim 23, wherein each deviation signal circuit (44) includes memory elements (52, 59), and the memory element (52, 59) is connected to the output of the associated comparator (45, 46).

30. System of claim 17, wherein the input of the deviation signal circuit (44) of the comparison means circuit (91) is preceded by a time-delaying and pulse-filtering element (81).

31. System of claim 17, wherein the machine speed reference value generating circuit (92) includes means (37) for adjusting the sensitivity.

32. System of claim 1, wherein the reference signal generating means (38, 41 . . . 41″, 43) is coupled to all of the measuring circuits (36 . . . 36″).

* * * * *